US006776725B1

(12) United States Patent
Miura et al.

(10) Patent No.: US 6,776,725 B1
(45) Date of Patent: Aug. 17, 2004

(54) GOLF CLUB HEAD

(75) Inventors: Koryo Miura, Machida (JP); Takeshi Naruo, Osaka (JP); Koji Sakai, Osaka (JP); Yoshihiro Fujikawa, Osaka (JP)

(73) Assignee: Mizuno Corporation, Osaka (JP)

( * ) Notice: Subject to any disclaimer, the term of this patent is extended or adjusted under 35 U.S.C. 154(b) by 420 days.

(21) Appl. No.: 09/463,695

(22) PCT Filed: May 19, 1999

(86) PCT No.: PCT/JP99/02609

§ 371 (c)(1),
(2), (4) Date: Jan. 31, 2000

(87) PCT Pub. No.: WO00/71210

PCT Pub. Date: Nov. 30, 2000

(51) Int. Cl.[7] ..... A63B 53/04
(52) U.S. Cl. ..... 473/327; 473/345; 473/349
(58) Field of Search ..... 473/324, 325, 473/326, 327, 328, 330, 331, 345, 346, 347, 348, 349, 350, 131; D21/733, 735

(56) References Cited

U.S. PATENT DOCUMENTS 3,524,288 A * 8/1970 Coppa
4,058,945 A * 11/1977 Knapp
5,060,951 A * 10/1991 Allen
5,190,289 A * 3/1993 Nagai
5,397,126 A * 3/1995 Allen
5,700,208 A * 12/1997 Nelms
6,001,029 A * 12/1999 Kobayashi

FOREIGN PATENT DOCUMENTS

| | | |
|---|---|---|
| JP | 54-100127 | 8/1979 |
| JP | 58-17348 | 8/1984 |
| JP | 59-22694 | 9/1985 |
| JP | 59-101594 | 2/1986 |
| JP | 4-135576 | 5/1992 |
| JP | 2561165 | 12/1996 |
| JP | 9-38248 | 2/1997 |

* cited by examiner

*Primary Examiner*—Sebastiano Passaniti
(74) *Attorney, Agent, or Firm*—McDermott Will & Emery LLP

(57) ABSTRACT

A golf club head (1) having a hollow portion is partly or entirely provided with a PCCP structure (2) excluding its face portion (16). By this structure, a golf club head having an outer body structure which permits the thickness of the head to be reduced without loss in the strength to be provided.

10 Claims, 4 Drawing Sheets

GOLF CLUB HEAD

TECHNICAL FIELD

The present invention relates to a head construction which allows an oversized golf club head having a hollow portion and mainly made from a metal to be implemented.

BACKGROUND ART

What is most required of a golf club in the performance is longer distance and stabler directivity. Those called professionals can always hit a ball at the same one point of the face of a golf club, the distance is longer a because of their high swing speeds and the hit ball is well controlled in he directivity. Amateur golfers however cannot hit at a steady point of the face portion, therefore the distance is not long and the directivity is not stable.

The simplest way of overcoming the disadvantage is to increase the volume of a golf club head as much as possible. Thus increasing the volume of a head however increases the weight of the head and the golf club as a whole can be unbalanced in the case of some metal wood golf club heads which are recently mainstream products.

Therefore, in general, the thickness of the outer body material of a head is reduced, or the weight of material per unit area is reduced, in order to increase the size of the head.

Some models employ high strength material for further reducing the thickness of the head.

Japanese Patent Laying-Open No. 9-38248 discloses a golf club head having a dimple shaped recess at a face member in order to increase the strength as compared to a simple plate material, while Japanese Patent Laying-Open No. 4-135576 discloses a golf club head whose material has its crystal grain size adjusted in order to improve the toughness of the material.

Such golf club heads manufactured by the above conventional improvement methods however encounter with the following problems.

Regarding the method of thinning the outer body material of a head for increasing the size of the head, if the thickness of the outer body material of a head is reduced only in view of impact at the time of hitting a ball, such heads collide against each other in a caddie bag during transport, they could be easily dented by the weight applied on the thinned portion thereof. It is also highly possible that the heads are dented even with other minor impacts.

The use of high strength material for the outer body material of the head is disadvantageous because the high strength material itself is generally costly and materials which can be used are limited as a result.

The method disclosed by Japanese Patent Laying-Open No. 9-38248 to provide a dimple has not yet been clearly explained about the mechanism of strength improvement, and therefore it is not clear if the effect can be stably provided. Furthermore, the peripheral portion of the dimple could be thicker than the case of using a simple plate material, which disadvantageously increases the weight.

The method of reducing the crystal grain size as disclosed by Japanese Patent Laying-Open No. 4-135576 may be effective to cope with repetitive weight applied in hitting because the toughness of the material is improved, but the strength is not improved, and therefore the durability does not improve relative to the weight.

DISCLOSURE OF INVENTION

In view of the foregoing, it is a main object of the present invention to provide a golf club head having an outer body construction which allows the thickness to be reduced without loss in the strength in a golf club head having a hollow portion.

The present invention allows a thin and oversized golf club head having a hollow portion to be provided by providing the golf club head with a PCCP (pseudo-cylindrical concave polyhedral) structure so that the strength is increased.

According to an embodiment of the present invention, a golf club having a hollow portion can be entirely or partly provided with a PCCP structure excluding the face portion.

The present invention includes an application of the PCCP structure to a wood golf club head having a hollow portion.

In a wood golf club head having a hollow portion according to such an embodiment in which the PCCP structure is applied to the wood golf club head, the PCCP structure can be continuously provided to surround the head in a direction parallel to the face portion from the crown portion to the sole portion via both side portions excluding the back portion.

In a wood golf club head having a hollow portion, the PCCP structure can be continuously provided in a direction perpendicular to the face portion from the crown portion via the back portion to the sole portion.

Furthermore, in a wood golf club head having a hollow portion, the crown portion and sole portion can be entirely or partly provided with the PCCP structure, or only the crown portion can be provided with the PCCP structure.

As a PCCP structure applied according to the present invention, for example, such a structure is employed in which the bases of each pair of triangles arranged adjoined with each other in a diamond shape define a thalweg, and the inclined sides define ridgelines to define a cylindrical shape. Such a PCCP structure may be employed in which the bases of each pair of trapezoids arranged adjoined with each other to form a hexagon define a thalweg, and the upper sides and the nonparallel sides define ridgelines so as to define a cylindrical shape. The vertexes of the thalweg and ridgelines are formed for example to define an obtuse angle or circular segment.

BEST MODE FOR CARRYING OUT THE INVENTION

In a golf club head according to the present invention, a so-called PCCP structure is employed for the outer surface. The "PCCP" is abbreviated from a "Pseudo-Cylindrical Concave Polyhedral" shell.

Figure 5:
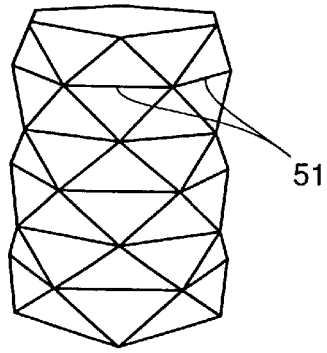
FIG. 5 is a perspective view of a cylindrical shape provided with a PCCP structure.

FIG. 5 is a view of a cylindrical shape provided with a PCCP structure, and FIGS. 6A to 6D are expansion plan views of the cylindrical shape provided with the PCCP structure.

As shown in FIG. 5, the PCCP structure has a shape close to a cylindrical shape macroscopically, but it is actually an arrangement of each pair of triangles with their bases adjoined with each other to form a diamond shape (as shown in FIG. 5) or an arrangement of each pair of trapezoids with their lower sides adjoined with each other to form a hexagon (not shown).

Figure 6A:
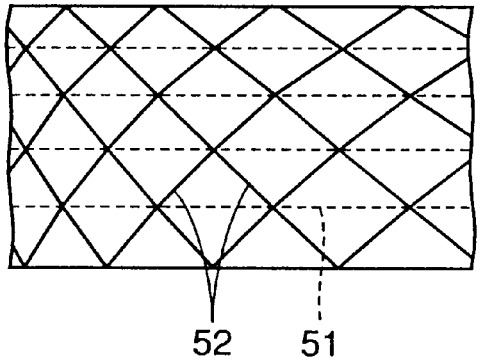
FIGS. 6A to 6D are expansion plan views of the cylindrical shape provided with a PCCP structure.
Figure 6B:
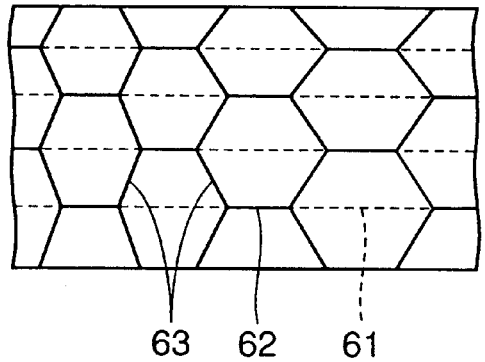
Figure 6C:
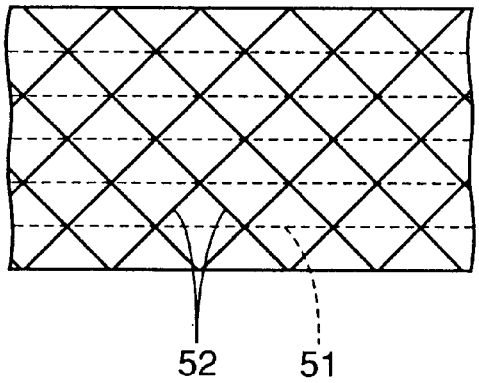

In FIGS. 6A to 6D, a solid line except for the outer circumference represents "ridgeline", while a broken line represents "thalweg". In a PCCP structure formed of triangles as shown in FIG. 6A or 6C, the bases 51 of each pair of triangles arranged in a diamond shape define a thalweg and nonparallel sides 52 define ridgelines to form a cylindrical shape.

Figure 6D:
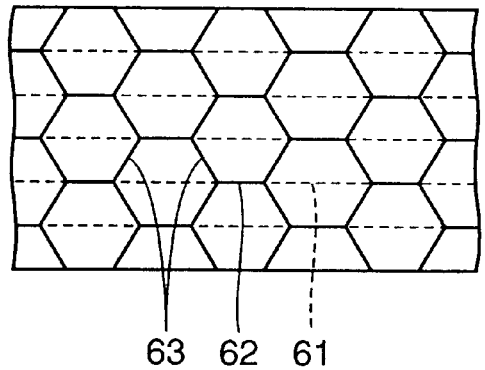

In a PCCP structure formed of trapezoids, as shown in FIG. 6B or 6D, the lower sides 61 of each pair of trapezoids arranged adjoined with each other to form a hexagon define a thalweg, and the upper side 62 and nonparallel sides 63 define ridgelines so as to form a cylindriical shape.

Note that in FIGS. 6A to 6D, the vertexes of ridgelines and thalwegs form an obtuse angle, but these parts may be formed into a circular segment.

The PCCP structure is formed of simple triangles or trapezoids, and can form an arbitrary radius of curvature by changing the length of each side as shown in FIG. 6A or 6B. As a result, a wood golf club head in a somewhat irregular cylindrical shape or a hollow iron golf club head having a back portion in an approximate semicircular shape may be provided with the structure.

The cylindrical shape formed of such a PCCP structure has higher rigidity and higher bending strength in the direction toward the central axis of the cylindrical shape than a cylindrical shape formed of a smooth curved surface having the same thickness. Therefore, the golf club head having the hollow portion can be designed to have a reduced thickness without loss in the strength toward the central direction.

This is established by the following Table 1.

TABLE 1

| | Can weight (g) | Thickness (transverse) (mm) | Compression yield point in circumferential direction (kgf) | Frequency in height-wise direction (Hz) |
|---|---|---|---|---|
| Conventional cylindrical can | 35.3 | 0.22 | 5.0 | 1396 |
| PCCP can | 26.0 | 0.17 | 5.0 | 1247 |

In Table 1, a cylindrical can having a diameter of 52 mm and a height of 104 mm formed of a conventional cylindrical shape is compared to a can provided with a PCCP structure.

The cylindrical can having the PCCP structure used for the experiment has a shape as shown in FIG. 5 which has as elements isosceles triangles of an identical shape with a base of 14.85 mm and inclined sides of 10.5 mm.

In both cans, when the compression yield point in the circumferential direction (the point at which the cylindrical shape starts to deform as increasing weight is applied in the circumferential direction) is set to 5 kgf, the conventional cylindrical can needs a thickness of 0.22 mm, while the can with the PCCP structure needs only a thickness of 0.17 mm according to Table 1.

As a result, the weight of the cylindrical can as a whole is 35.3 g for the conventional cylindrical can as compared to 26.0 g for the can with the PCCP structure, so that the weight can be reduced in the latter case by about 26%.

Specific embodiments of the present invention will be now described.

First Embodiment

Figure 1:
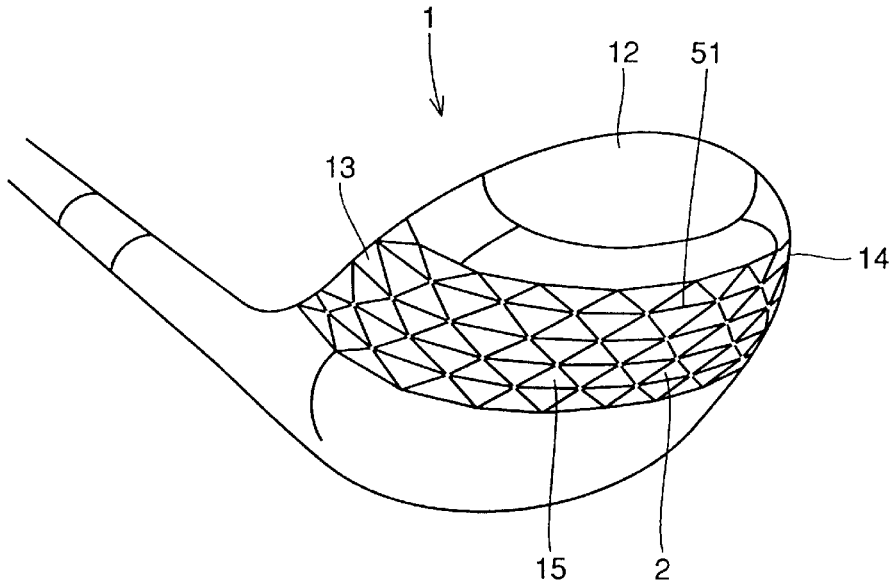
FIG. 1 is a wood golf club head provided with a PCCP structure according to a first embodiment of the present invention.

In a wood golf club head having a hollow portion in FIG. 1, a PCCP structure 2 is continuously provided to surround the head in a direction parallel to a face portion 16 from a crown portion 11 (the back side of FIG. 1 and hence not shown) via both side portions 13 and 14 excluding a back portion 12 to a sole portion 15.

The portion provided with PCCP structure 2 has its thickness reduced in any of crown portion 11, both side portions 13 and 14 excluding back portion 12 and sole portion 15 as compared to the case without the PCCP structure as given in the above Table 1.

As a result, the weight of a wood golf club head itself can be reduced for the same volume as the conventional case and the head can be enlarged for the same weight.

The part of PCCP structure 2 having its thickness reduced has the same strength as that of the conventional structure, such heads will not be dented by weight applied upon them as they collide against each other in a caddie bag during transport.

The use of PCCP structure 2 allows the material the same as that of the conventional head to be used, expensive high strength material is not necessary, and therefore the cost will not be raised.

Furthermore, the cylindrical shape provided with the PCCP structure has higher bending strength toward the direction of the central axis of the cylindrical shape as described above, while the PCCP structure having a triangle as an element has its rigidity lowered in the direction perpendicular to the continues bases, and the PCCP structure having a trapezoid as an element has its rigidity lowered in the direction perpendicular to the continuous upper and lower sides.

More specifically, in connection with the PCCP can having a triangle as an element used for the experiment of Table 1 as shown in FIG. 5, the rigidity is lowered in the direction perpendicular to bases 51 continuous in the circumferential direction, in other words in the direction of the height of the can. This can also be seen from Table 1 in that "the frequency in the height direction" of the PCCP can is lower than that of the conventional cylindrical can.

As a result, as shown in FIG. 1, if a PCCP structure is provided continuously to surround the head in the direction parallel to face portion 16 from crown portion 11 via both side portions 13 and 14 excluding back portion 12 to sole portion 15 and the base 51 of a triangle which is an element of the structure is also formed to be parallel to face portion 16, the rigidity in the direction perpendicular to face portion 16, in other words, in the direction from face portion 16 to back portion 12 (hitting direction) is lowered, so that increase in the initial speed of a hit ball could be expected.

Second Embodiment

Figure 2A:
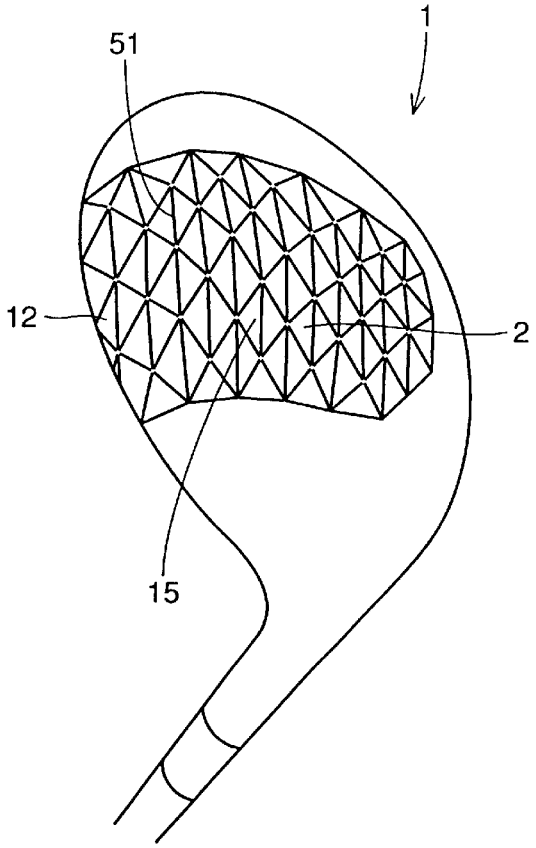
FIG. 2A is a perspective view of a wood golf club head provided with a PCCP structure according to a second embodiment of the present invention seen from the side of the sole portion.
Figure 2B:
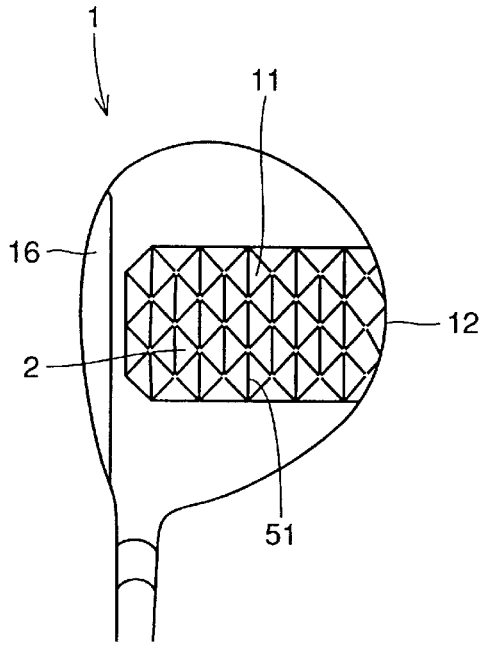
FIG. 2B is a plan view of the wood golf club head shown in FIG. 2A seen from the side of the crown portion.

FIGS. 2A and 2B show a wood golf club head having a hollow portion in which PCCP structure 2 is continuously provided in the direction perpendicular to face portion 16 from crown portion 11 via back portion 12 to sole portion 15.

Since the thickness of crown portion 11, back portion 12 and sole portion 15 provided with PCCP structure 2 can be reduced, the weight of wood golf club head 1 itself can be reduced as compared to the conventional head having the same volume, and the head can be oversized for the same weight.

Since the strength is not different from the conventional head, if the heads collide against each other, they will not be dented.

Furthermore, in wood golf club head 1 as shown in FIGS. 2A and 2B, the base 51 of a triangle which is an element of the PCCP structure is formed to be parallel to face portion 16, similarly to the above first embodiment, the rigidity in the direction perpendicular to face portion 16, in other words in the direction from face portion 16 to back portion 12 (hitting direction) is lowered and increase in the initial speed of a hit ball can be expected.

Third Embodiment

Figure 3A:
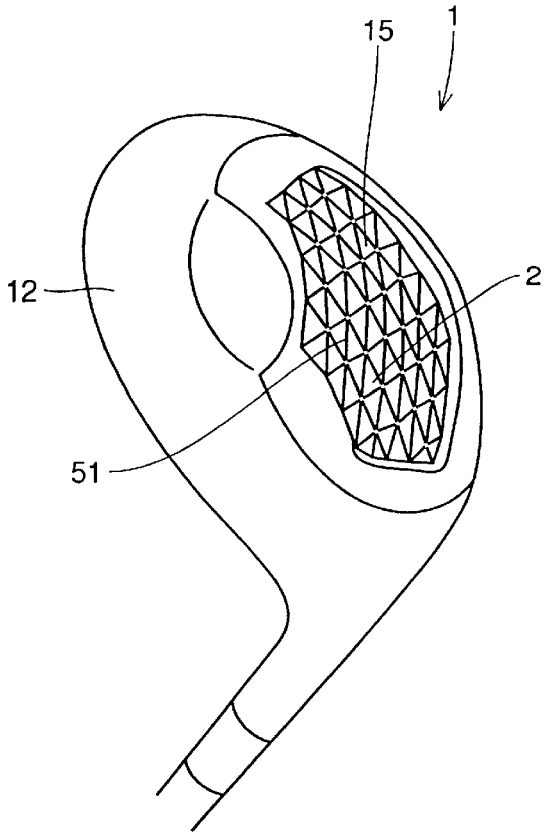
FIG. 3A is a perspective view of a wood golf club head provided with a PCCP structure according to a third embodiment of the present invention seen from the side of the sole portion.
Figure 3B:
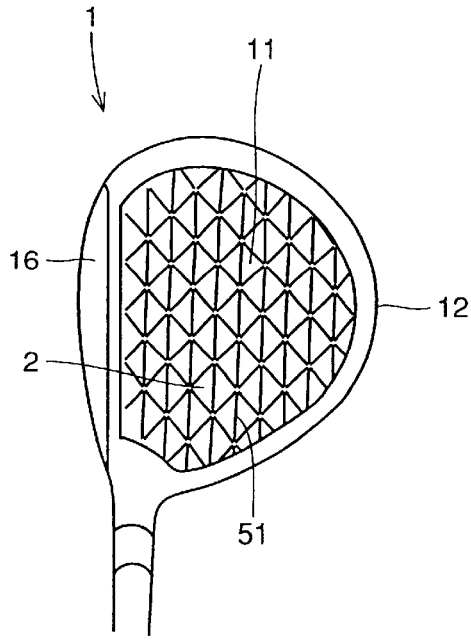
FIG. 3B is a plan view of the wood golf club head shown in FIG. 3A seen from the side of the crown portion.

In FIGS. 3A and 3B, the crown portion 11 and sole portion 15 of wood golf club head 1 are entirely provided with PCCP structure 2.

Fourth Embodiment

Figure 4A:
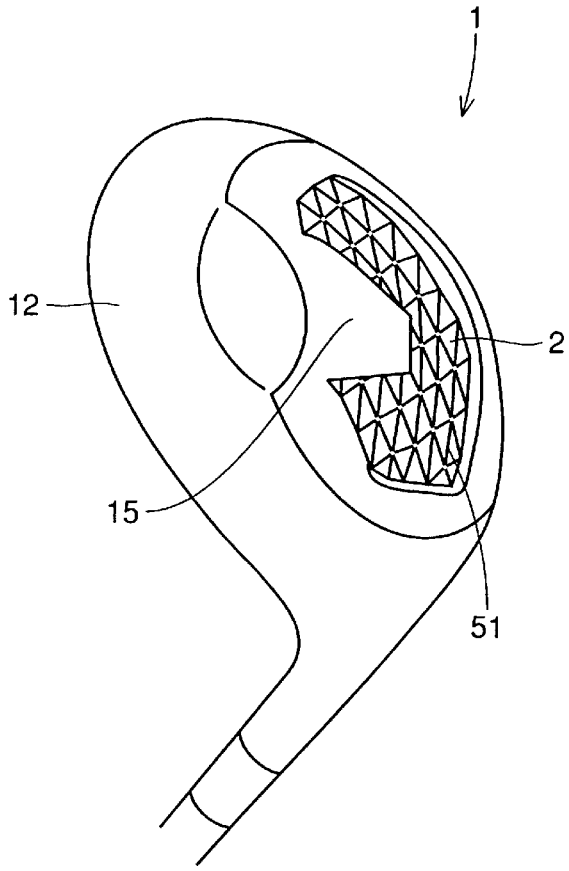
FIG. 4A is a perspective view of the wood golf club head provided with a PCCP structure according to a fourth embodiment of the present invention seen from the side of the sole portion.
Figure 4B:
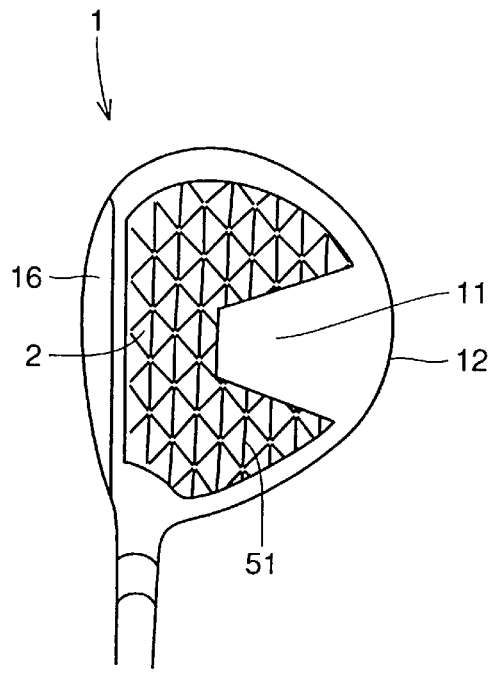
FIG. 4B is a plan view of the golf club head shown in FIG. 4A seen from the side of the crown portion.

In FIGS. 4A and 4B, the crown portion 11 and sole portion 15 of wood golf club head 1 are partly provided with PCCP structure 2.

Thus, if PCCP structure 2 is provided in only a limited manner to the crown portion 11 and sole portion 15 of wood golf club head 1, since the ratio of surface area of these portions in the entire wood golf club head 1 is large, wood golf club head 1 can be sufficiently lightweight.

In addition, crown portion 11 and sole portion 15 do not define a large curved surface unlike back portion 12 and side portions 13 and 14, and therefore a PCCP structure can be easily provided, so that wood golf club head 1 can be more readily manufactured.

As shown in FIGS. 4A and 4B, if PCCP structure 2 is provided at the crown portion 11 and sole portion 15 of wood golf club head 1 having a hollow portion at a position closer to face portion 16, the weight on the side of face portion 16 can be smaller than that on the side of the back portion 12 of the head.

Thus, the center of gravity is positioned closer to the side of back portion 12, which increases the depth of center of gravity, so that the sweet spot is effectively enlarged.

PCCP structure 2 can be provided in only a limited manner to sole portion 15 in FIG. 3A, crown portion 11 in FIG. 3B, sole portion 15 in FIG. 4A, or crown portion 11 in FIG. 4B.

As shown in FIGS. 3B and 4B, if PCCP structure 2 is provided only at the crown portion 11 of wood golf club head 1 having a hollow portion, the weight of crown portion 11 is reduced.

Therefore, if sole portion 15 is formed to have a conventional structure or sole portion 15 is attached with the weight reduced from crown portion 11, the center of gravity of wood golf club head 1 can be lowered, and as a result, a hit ball could be carried higher.

In the third embodiment in FIGS. 3A and 3B and the fourth embodiment in FIGS. 4A and 4B, if the base 51 of a triangle which is an element of the PCCP structure is formed parallel to face portion 16, the rigidity in the direction perpendicular to face portion 16, in other words in the direction from face portion 16 to back portion 12 (hitting direction) is lowered and increase in the initial speed of a hit ball can be expected if not as much as the second embodiment.

In addition to the foregoing embodiments, PCCP structure 2 can be positioned at an arbitrary part of wood golf club head 1 excluding face portion 16.

No matter what position PCCP structure 2 is provided at, the thickness of wood golf club head 1 can be reduced at that position and the weight can be reduced.

Therefore, since the weight can be adjusted by adjusting the range of the PCCP structure to be used, the flexibility in design can be increased in increasing the size of a head. As described above, the depth of center of gravity and the position of center of gravity can be readily adjusted.

Similarly in this embodiment, if the base of a triangle which is an element of the PCCP structure is formed to be parallel to the face portion, the rigidity in the hitting direction is lowered and increase in the initial speed of a hit ball can be expected.

Furthermore, the use of the PCCP structure allows interesting golf clubs in terms of design to be provided.

In the above described first to fourth embodiments, the PCCP structure having a triangle as an element is described, the same function and effects can be provided with a PCCP structure having a trapezoid as an element.

The embodiments are all related to a wood golf club head, but the structure may be provided to the face portion of other heads than such a hollow iron golf club head and still the same function and effects can be expected.

The heads according to the present invention can be manufactured by forging or casting.

If a PCCP structure is provided at a part of a golf club head, only the PCCP structure is produced by forging, casting or press working, and the parts of the head other than the part to be provided with the PCCP structure are fabricated by a known method, and the PCCP structure is joined to the head with a hole by adhesion, welding and fitting.

Industrial Applicability

As in the foregoing, according to the present invention, in a portion provided with a PCCP structure in a hollow golf club head, the outer body member of the golf club head can be made thinner than the case without the PCCP structure. As a result, if the head has the same volume as that of the conventional head, the weight of the head itself can be reduced, and the head can be oversized for the same weight.

In addition, even in the PCCP structure having a smaller thickness than the conventional case, the strength is not different, and therefore if the heads collide against one another in a caddie bag during transport, the heads will not be dented by weight applied on them.

Furthermore, since the same material as that of the conventional head can be used with the PCCP structure, expensive material is not necessary, and therefore the cost will not be raised.

If the base of a triangle or the parallel sides of a trapezoid, both an element of the PCCP structure, are formed parallel to the face portion, the rigidity in the hitting direction perpendicular to the face portion is lowered and increase in the initial speed of a hit ball can be expected.

The PCCP structure can be provided to an arbitrary part of a golf club head excluding the face portion, and no matter what position the PCCP structure is provided at, the part can be reduced in thickness, so that the weight of the golf club head can be reduced.

In particular, the crown portion and sole portion occupy a large surface area in the entire area, the radius of curvature is smaller than those of the back side and side portions, so that they can therefore be readily manufactured and significant effects are provided.

Furthermore, the weight can be adjusted by adjusting the range to apply the PCCP structure, the flexibility in design can be increased at the time of increasing the size of the head.

For example, if a PCCP structure is provided at a position of the crown and sole portions of a wood golf club head closer to the face portion, the weight on the side of the face portion can be smaller than that on the side of the back portion of the head, the depth of center of gravity is increased, and the sweet spot can be enlarged.

Furthermore, if a PCCP structure is provided only at the crown portion, the weight of the crown portion can be reduced and the center of gravity can be lowered, so that a hit ball can be carried high.

What is claimed is:

1. A golf club head having a hollow portion comprising a PCCP structure, said PCCP structure defining a central axis oriented to intersect a plane defined by a face portion of said golf club head.

2. A golf club head having a hollow portion comprising a PCCP structure according to claim 1, wherein said central axis defined by said PCCP structure is substantially perpendicular to a plane defined by a face portion of said golf club head.

3. The golf club head according to claim 2, wherein said golf club head includes a crown portion, a back portion, a sole portion, a face portion, a left side portion, and a right side portion, and wherein the PCCP structure extends around the club head in a direction parallel to said face portion from said crown portion to said sole portion via the left side portion and right side portion.

4. The golf club head according to claim 2, wherein said golf club head includes a crown portion, a back portion, a sole portion, a face portion, a left side portion, and a right side portion, and wherein the PCCP structure extends around the club head in a direction perpendicular to said face portion from said crown portion to said sole portion via said back portion.

5. The golf club head according to claim 2, wherein said golf club head includes a crown portion, a back portion, a sole portion, a face portion, a left side portion, and a right side portion, and wherein the PCCP structure is disposed only on at least one of said crown portion and said sole portion.

6. The golf club head according to claim 2, wherein said golf club head includes a crown portion, a back portion, a sole portion, a face portion, a left side portion, and a right side portion, and wherein the PCCP structure is disposed only on said crown portion.

7. The golf club head according to claim 1, wherein said PCCP structure includes a pair of triangles having bases arranged adjoined with each other, said bases forming a thalweg and the inclined sides forming ridgelines to define a cylindrical shape.

8. The golf club head according to claim 7, wherein the vertexes of said thalweg and said ridgelines in said PCCP structure form an obtuse angle or circular segment.

9. The golf club heading according to claim 1, wherein the PCCP structure includes a pair of trapezoids having lower bases adjoined with each other to form a hexagon, said lower bases forming a thalweg, and the upper side and non-parallel sides form ridgelines to define a cylindrical shape.

10. The golf club head according to claim 9, wherein the vertexes of said thalweg and said ridgelines in said PCCP structure form an obtuse angle or circular segment.

* * * * *

UNITED STATES PATENT AND TRADEMARK OFFICE

CERTIFICATE OF CORRECTION

PATENT NO. : 6,776,725 B1
DATED : August 17, 2004
INVENTOR(S) : Miura et al.

It is certified that error appears in the above-identified patent and that said Letters Patent is hereby corrected as shown below:

Title page,
Item [*] Notice, delete "420" and insert -- 677 --.

Signed and Sealed this

Thirtieth Day of August, 2005

JON W. DUDAS
*Director of the United States Patent and Trademark Office*